United States Patent [19]

Elmer

[11] 4,422,133

[45] Dec. 20, 1983

[54] ILLUMINATING DEVICE WITH REFLECTOR PORTIONS AND VOIDS OPPOSITE THEREOF

[76] Inventor: William B. Elmer, 2 Chestnut St., Andover, Mass. 01810

[21] Appl. No.: 319,251

[22] Filed: Nov. 9, 1981

[51] Int. Cl.[3] ..... F21V 7/10

[52] U.S. Cl. ..... 362/277; 362/145; 362/307; 362/217; 362/310; 362/223; 362/319; 362/297; 362/344; 362/347; 362/348; 362/350; 362/375; 362/431

[58] Field of Search ..... 362/145, 282, 283, 297, 362/309, 310, 346, 347, 350, 277, 147, 217, 223, 307, 344, 348, 375

[56] References Cited

U.S. PATENT DOCUMENTS

| | | | |
|---|---|---|---|
| 2,693,524 | 11/1954 | Harris | 362/350 |
| 3,502,865 | 3/1970 | Matteson | 362/309 |
| 4,177,504 | 12/1979 | Henderson, Jr. et al. | 362/350 X |
| 4,239,369 | 12/1980 | English et al. | 362/297 |
| 4,316,241 | 2/1982 | Gulliksen | 362/283 X |
| 4,338,655 | 7/1982 | Gulliksen et al. | 362/283 X |
| 4,347,554 | 8/1982 | Matsushita | 362/348 X |
| 4,347,555 | 8/1982 | Elmer | 362/347 X |
| 4,358,816 | 11/1982 | Soileau | 362/347 X |

*Primary Examiner*—Peter A. Nelson
*Attorney, Agent, or Firm*—Hieken, Charles

[57] ABSTRACT

A luminaire has a spherical or ovoid reflector formed with asymmetrical voids that allow beams from the lightbulb in the reflector to emerge side-by-side through the voids in opposite directions after reflection from opposite internal surfaces of the reflector.

6 Claims, 6 Drawing Figures

ILLUMINATING DEVICE WITH REFLECTOR PORTIONS AND VOIDS OPPOSITE THEREOF

The present invention relates in general to illuminating and more particularly concerns novel apparatus and techniques for providing a light reflector for providing two beams in opposite directions with a reflector that is relatively inexpensive, relatively easy to manufacture and capable of operating for a relatively long time.

In the design of conventional street lights a single optical system is used which sends out strong beams of light in nearly opposite directions, one each in the two street directions extending away from the location of the light. The light intensity projected directly below the light is less than that of the two generally oppositely directed main beams.

In most street lights the optics are symmetrical on either side of the centerline of the luminaire. The optics are so designed that as much of the reflected light as possible from one side of the reflector is projected at as high an angle as possible without being intercepted by the other side of the reflector. This seriously limits the quantity of light that can be projected in the two main opposite beams.

In order to overcome this difficulty, many luminaries are designed with refracting transparent fittings extending below the edges of the reflector. Where these are used, the reflector is designed to project more powerful beams at lower vertical angles than otherwise acceptable, and the prismatic patterns of the refractors then lift the two main opposing beams to the desired angle. By the use of this optical principle the required beam strength is achieved, but at the substantial expense of providing the additional refracting accessory.

It is an object of the present invention to obviate the need for the expensive, superfluous refracting accessory by a novel design of the reflector, which is made asymmetric in such manner that fully adequate beam strengths are realized in the two opposite roadway directions.

According to the invention, a lighting device for producing at least two major beams of light in substantially different directions includes a light source within a reflector of generally spherical or ovoid form. The reflector surface is formed with voids to allow each major beam to bypass each other and provide illumination along a respective direction. This reflector has depending first and second side portions on opposite sides of the reflector lengthwise axis. These side portions are relatively displaced in a direction generally parallel to the lengthwise axis to create first and second voids. A light source is supported inside the reflector so that the reflector may direct light energy from the light source into at least first and second major beams of light in substantially different first and second directions respectively after reflection from the first and second side portions respectively with each of the first and second major beams bypassing each other and emerging from the reflector through the voids beside the second and first side portions respectively. According to a specific form of the invention two portions of the generally ovoid reflector are positioned to project bypassing main beams along substantially opposed directions passing through voids of the reflector opposite the main reflecting areas to allow transmission of two main beams through the respective voids. More specifically, the voids are located in two diagonally opposite portions of the lower reflector surface. In a specific form the voids are on the right side of the lower reflector body when viewed from either side of the reflector. The lighting device may be divided lengthwise into four asymmetric sections with a void being formed in one of the two upper sections and a second void in the diagonally opposite lower section, whereby the remaining sections are enabled to project main beams in generally opposite directions through respective ones of the voids. According to still another feature of the invention, the main reflecting areas may be detachably secured to the reflector to permit conversion from bidirectional to monodirectional operation by removing one of the two main reflecting areas and adding another main reflecting area adjacent to and supplementing the remaining main reflector section so that both voids are on the same side of the reflector.

Numerous other features, objects and advantages will become apparent from the following specification when read in connection with the accompanying drawing in which.

Figure 1A:
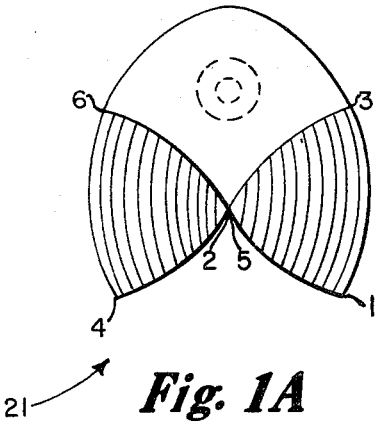
FIGS. 1A, 1B and 1C are end, side and bottom views, respectively of an embodiment of the invention.
Figure 1B:
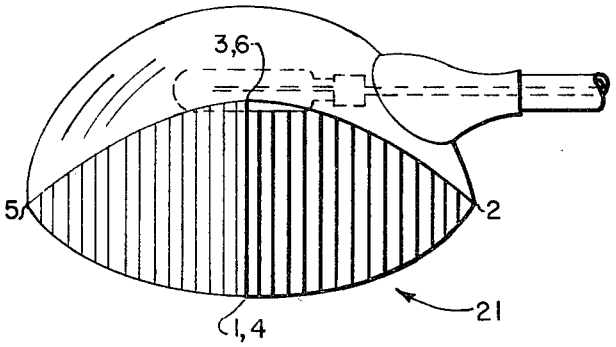
Figure 1C:
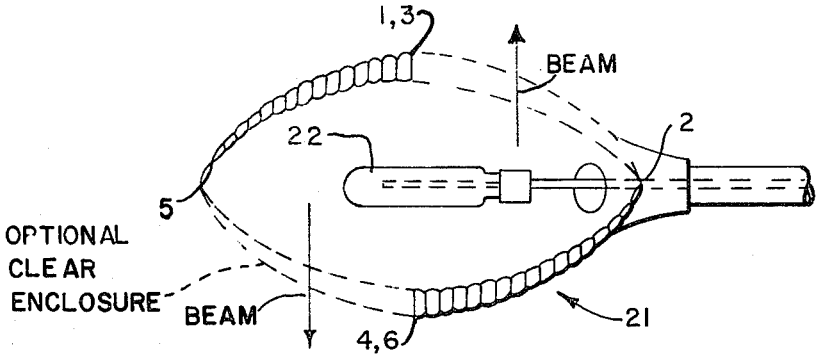

With reference now to the drawing and more particularly FIGS. 1A, 1B and 1C thereof, there are shown end, side and bottom views, respectively, of an embodiment of the invention. These views show a generally ovoid reflector form 21 with the entire bottom most portion removed as indicated below numerals 1,2,4,5. In addition two other unsymmetrical sections are removed from the lower edge, as indicated by 1,2,3 and 4,5,6.

When viewing the reflector 21 from the side, the cutaway section 1,2,3 permits the far side of the interior of the reflector to be seen. This permits the light from bulb 22 reflected from said far side of the interior to emerge from the reflector without interference or conflict with the near side of the reflector as would occur in conventional street light reflectors having both sides symmetrical. This construction permits a design of the reflecting surfaces to be so shaped that there is no limit to the quantity of reflected light that can be projected at the desired high angles, such as 65, 70, or 75 degrees above nadir. When looking at the side view of FIG. 1B, the light reflected from area 2,4,6 is generally directed toward the viewer and the light reflected from area 1,3,5 is generally directed away from the viewer.

The geometric shape of the reflector is susceptible to various forms, depending upon the height of mounting, the width of the street, and the constraints of manufacturing technology. The preferred form is one in which the main reflecting areas are made generally paraboloidal, with the major axis of the paraboloid extending from the reflector to a specified distant point on the street surface, and said surfaces may be provided with generally vertical flutings so designed as to spread the reflected beam across the width of the street laterally. Other treatments of the surface contours are considered within the scope of the invention, such as peens, dents, and such other patternings as may be specified by the reflector designer to suit the particular street geometry to be illuminated.

Figure 2:
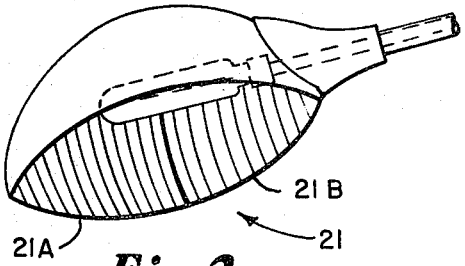
FIG. 2 is a perspective view of another embodiment of the invention having detachably secured reflecting sections for enabling conversion between bidirectional and monodirectional units.

Another form of the reflector here contemplated is one in which the major patterned reflecting sections 21A,21B,21C,21D are made detachable. The luminaire can then be converted from a bidirectional unit to a monodirectional unit by removing one appropriate major reflecting section and adding another appropriately shaped reflecting section to the opposite side, thus making one side of the reflector complete and leaving the other side completely open, as shown in FIG. 2.

The advantages of the invention are, (1) the cost and weight of refracting glass or plastic components of the luminaire are saved, (2) the loss of light flux in passing through a refracting element is eliminated, (3) the danger of falling shards of glass or plastic elements is eliminated, (4) collection of rain water, as in completely enclosed refractors is eliminated and (5) the expense of periodic cleaning and occasional replacement of broken glassware is saved.

Figure 3:
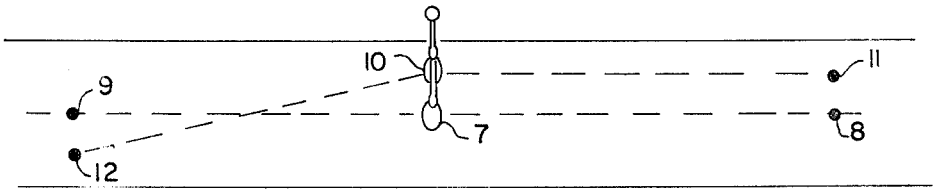
FIG. 3 is a diagrammatical representation of an embodiment of the invention illuminating a roadway.

FIG. 3 shows a plan view of a short stretch of roadway illuminated by the luminaire of FIGS. 1A-C. The geometric configuration of the luminaire can be symmetrical fore and aft about the midsection 3,1,4,6, making the luminaire suitable for mounting directly over the centerline of the roadway as indicated by 7 in FIG. 3. In this case the reflecting area 2,4,6 will project its high beam toward a point 8 on the street surface and the reflecting area 1,3,5 will project its opposite high beam toward point 9 on said surface.

Many streets are too wide for center-street mounting of the luminaire as this would require an impractically long arm overhanging the street. In such cases the luminaire is mounted offcenter nearer to the supporting pole as shown by 10 in FIG. 3. In this case the reflector designer has the option of making the optics asymmetric about said centerline, in which case he may prefer to project the high beam from area 2,4,6 toward point 11 on the street surface and the opposite high beam from area 1,3,5 toward point 12 on said surface. It will be seen that this arrangement of the optics minimizes the possibility that light from the inner vertical edge of one reflecting section will be obstructed by the corresponding inner edge of the opposite reflecting section.

Those skilled in the art may use numerous optical arrangements within the principles of the invention. An important feature of the invention is the asymmetry of the reflector which permits the escape of ample quantities of light in two nearly opposite directions without mutual interference of the opposing edges as in conventional street lighting reflectors.

An advantageous feature of the invention is that the lower edges 2,4 and 1,5 of the reflector can be extended down lower than is possible with conventional reflectors, permitting the acceptance of more light flux from the light source 22 to be usefully redirected, and also, providing more protection to the fragile glass light source 23 within the reflector from missiles and from weather. Should it be found by experience in certain unfavorable locations that excessive lamp losses are experienced from missiles, clear relatively inexpensive transparent sections can be provided to fill in the openings 1,2,3 and 4,5,6. Such sections would be shaped with curvatures matching those of the reflector.

A further advantage of the invention is that the very substantially lower cost of the luminaire that is realized by eliminating the heavy, expensive, fragile prismatic refractors commonly used with most street lights, will permit the reflector to be made larger in size without undue increase in luminaire cost. The prevailing use of refracting enclosures in current American luminaire designs has forced the use of small luminaire sizes which in turn has caused modern street lights to be excessively glaring. By enlarging the luminaries the unit brightness can be reduced and American street lighting can be made less glaring and night driving made more comfortable for the public. The glare from street lights has been a traditional concern to the technical bodies concerned with street lighting. This invention can make the first substantial breakthrough in solving this hitherto unsurmountable difficulty.

Although the ribbing, fluting, patterning or peening such as shown in the drawing is generally preferred because the brightness of the active reflecting surface is reduced and made more uniform thereby, these treatments are not always necessary and the use of smooth surfaces is within the concept of the invention. Whether or not fluting or other patterning of the main reflecting surface is used could depend upon the kind of lamp used in the luminaire. Fluting could be desirable in order to obtain lateral coverage of the street if the lamp is of the type with concentrated filament. But many modern lamps using gaseous conductors are burned horizontally, causing the actual light source to be very wide. The reflected beam from such a lamp would be spread widely on the street surface even if the main reflector areas are left smooth.

Figure 4:
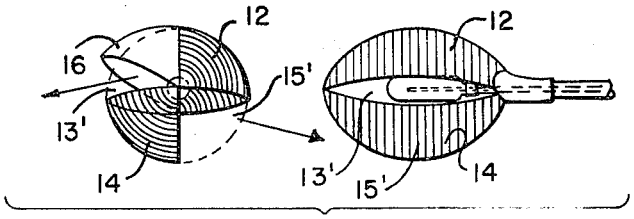
FIG. 4 are end and side views, respectively, of an embodiment of the invention with protective clear transparent covers.

Another form of the invention is shown in FIG. 4. In this form the asymmetry is vertical instead of horizontal. With the generally ovoid reflector form divided generally into upper halves, and these halves again subdivided into lengthwise quarters, one upper quarter is removed and an opposite lower quarter is also removed. Thus in FIG. 4 upper quarter 13 and lower quarter 15 are removed, permitting light from upper quarter 12 and lower quarter 14 to emerge respectively from the luminaire without obstruction by the opposite wall of the ovoid.

In certain applications of the FIG. 4 form of the invention it may be advisable to cover either one or both of the openings with clear transparent covers conforming to the shape of the luminaire. Transparent cover 13', for example, may be needed in locations where heavy snowfall is experienced, and similar covers (13' and 15') may be necessary in locations where vandalism or smoky atmospheres are excessive.

It should be understood that the scope of this invention is not limited to main beams of equal size. It is anticipated that some task configurations may require more illumination intensity in one of the directions than in another of the directions. In such case the relative areas of the main reflecting sections will differ.

It should be further understood that the use of this invention is not limited to the illumination of roadways. The luminaires may be mounted vertically to illuminate long walls or the sides of long low buildings, or may even be tipped sideways if necessary to illuminate towers or tall buildings, for example, from a high point on an adjacent building or structure.

Referring again to the variety of this invention shown in FIG. 4, it will be observed that some of the direct light from the light source will emerge at high angles through the clear area 13. In street lighting applications this would be wasteful and a source of inefficiency. Accordingly a visor 16 can be added to the luminarire to reclaim this lost light and redirect it downward toward the roadway where it will be utilized.

There has been described novel apparatus and techniques for illuminating. It is evident that those skilled in the art may now make numerous uses and modifications of and departures from the specific embodiments described herein without departing from the inventive concepts. Consequently, the invention is to be construed as embracing each and every novel feature and novel combination of features present in or possessed by the apparatus and techniques herein disclosed and limited solely by the spirit and scope of the appended claims:

What is claimed is:

1. Lighting apparatus for producing at least two major beams of light in substantially different directions comprising, reflecting means having depending first and second side portions on opposite sides of the reflecting means lengthwise axis for reflecting light from a source therein, means for supporting a light source within said reflecting means so that said reflecting means may direct light energy from said light source into said at least first and second major beams of light in substantially different first and second directions respectively after reflection from said first and second side portions respectively, said reflecting means being formed with said first and second side portions being relatively displaced in a direction generally parallel to said lengthwise axis to create voids allowing each of said first and second major beams to bypass each other after reflection from said first and second side portions respectively and emerge from said reflecting means through said voids beside said second and first side portions respectively.

2. Lighting apparatus in accordance with claim 1 for illuminating relatively narrow and elongated areas such as roadways or long walls in which said reflecting means has said first and second side portions so disposed as to project bypassing major beams toward opposite portions of said relatively narrow and elongated area and two of said voids are created opposite respective ones of said first and second side portions to allow said two major beams to emerge through respective ones of said two voids.

3. Lighting apparatus in accordance with claim 2 wherein said two voids are created in two diagonally opposite portions of said reflecting means to allow passage of two generally opposite side-by-side major beams from respective ones of said two diagonally opposite portions.

4. Lighting apparatus in accordance with claim 3 in which the nearer of said voids is located on the right side of the lower portion of said reflecting means when viewed from either side.

5. Lighting apparatus in accordance with claim 2 wherein said reflecting means comprises four asymmetric sections with one of said voids being formed in one of the two upper sections and a second of said voids being formed in the diagonally opposite lower section of said reflecting means, whereby the other two of said four asymmetric sections comprise said first and second side portions and are enabled to project major beams in generally opposite directions through respective ones of said voids.

6. Lighting apparatus in accordance with any one of claims 1–5 wherein said reflecting means comprises detachably securable reflecting surfaces comprising means for selectively converting said lighting apparatus from bidirectional to monodirectional operation by selectively attaching detachably securable reflecting portions.

* * * * *